US007162852B2

(12) United States Patent
Eder

(10) Patent No.: US 7,162,852 B2
(45) Date of Patent: Jan. 16, 2007

(54) DEVICE FOR FILLING STAND-ALONE FLAT-BOTTOM BAGS

(75) Inventor: Erich Eder, Donaustauf (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 10/491,182

(22) PCT Filed: Aug. 6, 2003

(86) PCT No.: PCT/EP03/08670

§ 371 (c)(1),
(2), (4) Date: Sep. 9, 2004

(87) PCT Pub. No.: WO2004/014729

PCT Pub. Date: Feb. 19, 2004

(65) Prior Publication Data

US 2005/0229550 A1 Oct. 20, 2005

(30) Foreign Application Priority Data

Aug. 6, 2002 (DE) ..... 102 35 929

(51) Int. Cl.
*B65B 43/18* (2006.01)
*B65B 43/14* (2006.01)

(52) U.S. Cl. ..... 53/571; 53/253; 53/584.7; 53/386.1; 53/389.1; 141/114; 141/144; 141/314

(58) Field of Classification Search ..... 53/571, 53/389.1
See application file for complete search history.

(56) References Cited

U.S. PATENT DOCUMENTS 2,722,358 A * 11/1955 Wilson ..... 53/385.1
2,768,493 A * 10/1956 Holler ..... 53/381.6
3,323,280 A * 6/1967 Rausch ..... 53/571
3,382,644 A * 5/1968 Vogt ..... 53/455
3,465,499 A * 9/1969 Nelson et al. ..... 53/386.1
3,961,461 A * 6/1976 Ruf et al. ..... 53/571
4,045,940 A * 9/1977 White et al. ..... 53/447
4,473,989 A * 10/1984 Tsutsumi et al. ..... 53/459
4,580,473 A 4/1986 Seiden et al.
4,913,765 A * 4/1990 Tetenborg et al. ..... 156/498
6,244,307 B1 6/2001 Araki et al.
6,499,280 B1 * 12/2002 Tsutsui ..... 53/570
6,964,146 B1 * 11/2005 LaRocca ..... 53/459

FOREIGN PATENT DOCUMENTS

DE 4035815 A1 5/1992
EP 0576058 B1 2/1998
EP 1029788 A2 8/2000
JP 6-32326 * 6/1994

* cited by examiner

*Primary Examiner*—John Sipos
(74) *Attorney, Agent, or Firm*—Marshall, Gerstein & Borun LLP

(57) ABSTRACT

A device for filling stand-alone flat-bottom bags with opposing side edges and a bottom, in particular filling them with liquid including a filling carousel which can rotate about a vertical axis and which has a plurality of holders for one bag each provided on its circumference. The filling carousel has a bag feeding station, a bag opening station, a filling station and a removal station as well as a sealing station. To optimize the filling device and in particular to achieve a higher throughput, a magazine for prefabricated bags and a feeding carousel for the bags is provided in the bag feeding station, containing a plurality of holding devices for one bag each whereby the holding devices can be driven to rotate about a common axis in order to remove each bag individually from the magazine and transfer it continuously to a holder of the filling carousel.

17 Claims, 9 Drawing Sheets

DEVICE FOR FILLING STAND-ALONE FLAT-BOTTOM BAGS

FIELD OF THE INVENTION

This invention relates to a device for filling stand-alone flat-bottom bags of the type described in the definition of the species of claim 1

BACKGROUND OF THE INVENTION

Such a device is known from European Patent 576 058 B1. The known device includes a filling carousel which revolves continuously and is charged directly by a bag shaping machine. The bag shaping machine processes film material from a roll to form a bag strand, then it cuts this bag strand into individual bags and transfers the individual bags to a synchronizing device which then transfers them to the continuously revolving filling carousel. Although it is mentioned in said publication that prefabricated bags from a magazine can also be used, the synchronizing device must be retained. The type and design of the synchronizing device is not described, but the description does indicate that evidently linearly movable arms are used. Nor does it describe how the bags are held on the filling carousel. The bags are opened by means of suction cups on the filling carousel and then are filled. Thereafter, the filled bags while still open are transferred to an intermediate wheel from which they subsequently go to a sealing device in the form of a sealing carousel. Although this publication cites the related art as indicating that efficiency is improved with the known device, the known device still has weaknesses, however. One of these weaknesses is the synchronizing device which fills the bags on the filling carousel. The second weakness is the intermediate wheel, which transports the open filled bag, the speed of this transport being limited to ensure that the contents of the bag, in particular when filled with fluid, do not overflow out of the bag.

A great variety of such bag filling machines are known in the related art. U.S. Pat. No. 3,323,280, for example, discloses a filling carousel for filling bags with granules. The bags are prefabricated and supplied in a bag magazine from which they are transferred in a linear movement to the filling carousel. In the filling carousel the bags are gripped by a clamping gripper on each of two opposing side seams; the clamping grippers can be moved in relation to one another to open the bag. This movement of the clamping grippers is relatively complicated to perform. Before closing the opening, which is done by sewing in this case, the bags are rotated, which in turn must be accomplished by a complex superimposed movement of the clamping grippers.

U.S. Pat. No. 4,580,473 describes a bag filling device which uses a continuous conveyor that conveys the bags, which are clamped onto a continuous conveyor belt, through the different stations. In conveyance, the bag is clamped to only one of these side seams with the help of a clamping gripper. However, the clamped side seam is the forward side seam, which in turn has the disadvantage that both side walls of the bag are no longer available for opening and on the other hand the throughput of bags is greatly reduced because now the bags have their largest dimensions pointing in the direction of conveyance.

SUMMARY OF THE INVENTION

Thus the object of this invention is to improve upon a device of the type mentioned above which will increase its efficiency.

With the design according to this invention, a considerable optimization of the filling device is achieved because the bags can be charged to the filling carousel continuously and nevertheless they are charged from a magazine of prefabricated bags. Neither the fabrication of the bags nor their being made available in cycles by means of the required severing cut thus forms a limit for the operating speed of the filling carousel.

In addition, one of the embodiments is also of particular advantage; when taken alone, i.e., without the charging carousel, this leads to a significant increase in operating speed of the bags because now the charging of the bags can take place in a very simple manner because no second gripping device stands in the way and the throughput, i.e., the number of bags that can be accommodated on the filling carousel, is optimized.

In addition, due to the fact that the bags are clamped on only one side, it is also possible to integrate the suction gripper for opening the bag into the holder for the bag. The additional supporting area made available its mobility, and the possibility of centering permit further optimization of the holding of the bags on the filling carousel and in particular a better adaptation to subsequent processing steps.

This object is also achieved, optionally only by this feature, by the sealing carousel because is it capable of transferring the bags directly from the filling carousel, i.e., without an intermediate wheel.

With the present invention, the sealing device of the bag sealing carousel can at the same time assume conveyance functions.

BRIEF DESCRIPTION OF THE DRAWINGS

Advantageous embodiments of this invention are illustrated in greater detail below on the basis of the drawings, which show.

DETAILED DESCRIPTION OF THE INVENTION

Figure 1:
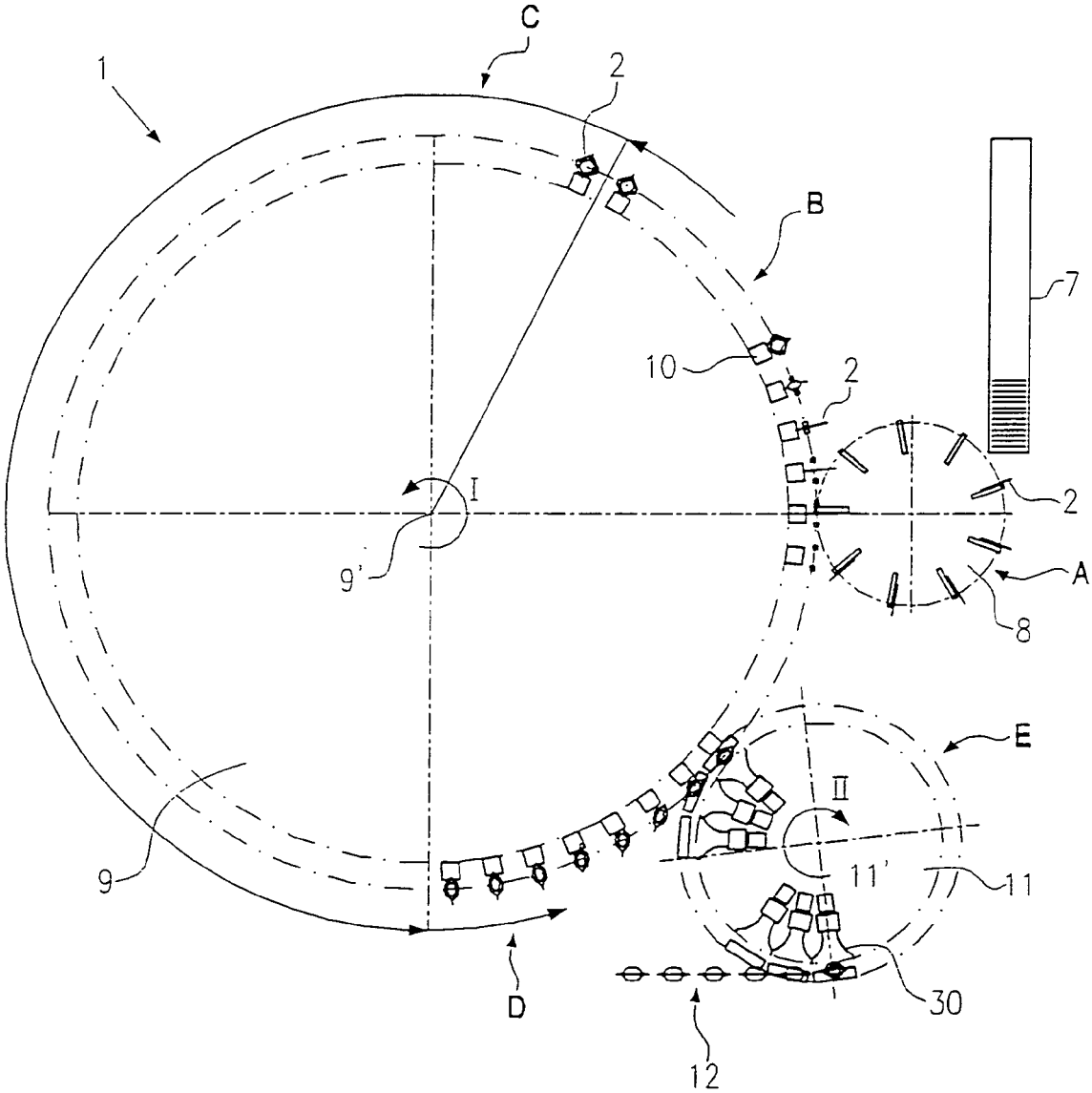
FIG. 1 a schematic diagram of an inventive device as seen from above.
Figure 2:
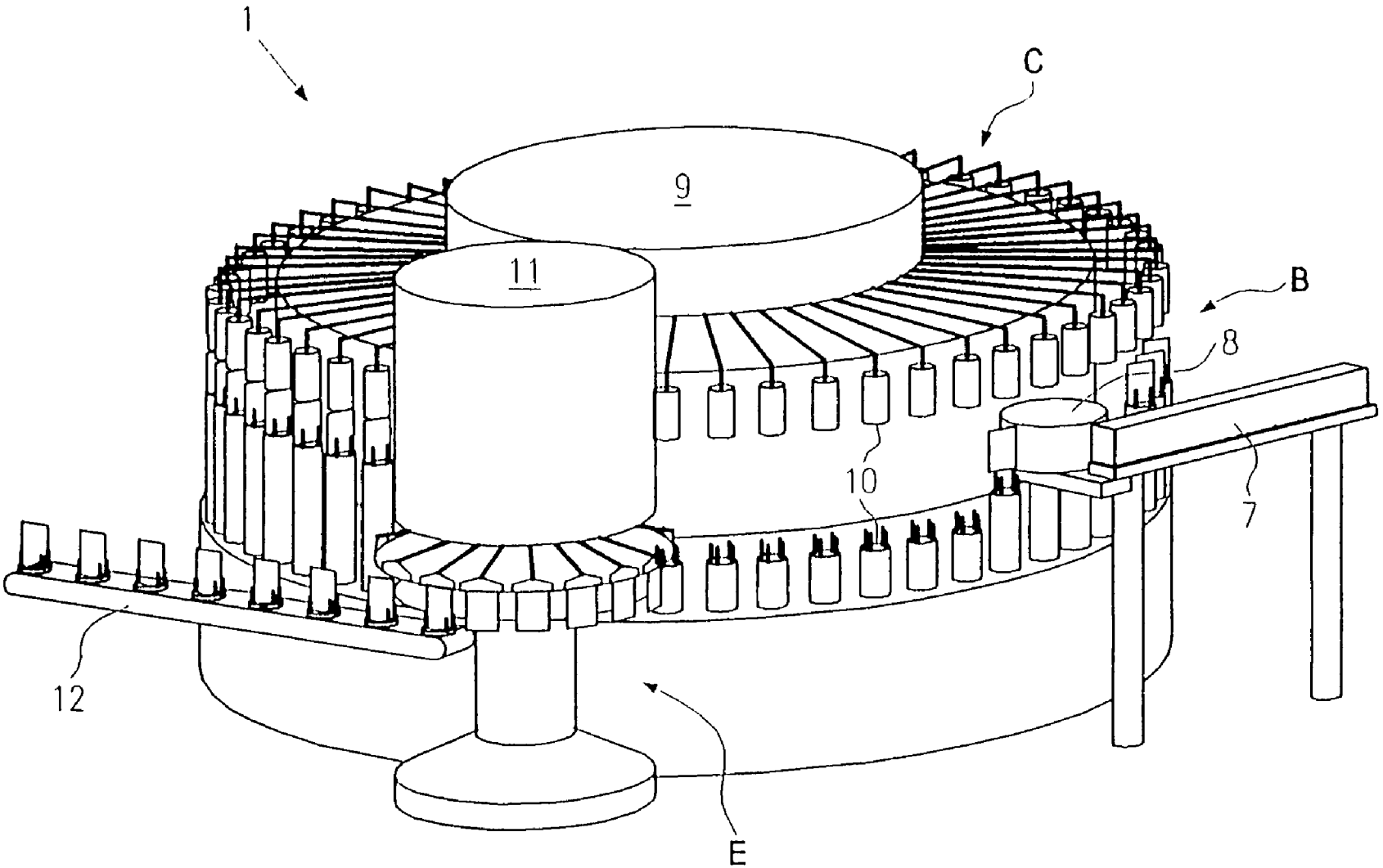
FIG. 2 the device according to FIG. 1 in a perspective side view.

FIGS. 1 and 2 show schematic diagrams of a device 1 for filling stand-alone flat-bottom bags 2. Stand-alone flat-bottom bags are widely used for packaging, and are used among other things for packaging individual portions of liquids, in particular beverages. Each stand-alone flat-bottom bag 2 (see also FIGS. 6 through 9) consists of two side walls 3, 4 made of a flexible film material joined together on their long sides by welds 2*a*, 2*b* and on their short sides by an inserted or folded stand-alone bottom 5. The side opposite the stand-alone bottom 5 has a filling opening 6 which is also sealed after the container has been filled.

The bags 2 are prefabricated, i.e., they are provided with side seams 2*a*, 2*b* and stand-alone bottoms 5 but with the filling opening 6 still open and a stock of bags is kept in a magazine 7. The bags 2 are removed individually from the magazine 7 at a bag feeding station by means of a feeding carousel 8 which is driven to rotate about a vertical axis 8' and they are transferred continuously to a filling carousel 9 which is also driven to rotate about a vertical axis 9' which preferably runs parallel to the axis 8', so that their rotation is in synchronization with the feeding carousel 8 and in the direction of the arrow I. On the circumference of the filling carousel 9, a plurality of holders 10 are provided at uniform intervals, shown here only schematically and with the first and last holder for each process step. The filling carousel 9 carries the bags 2 that are held in the holders 10 through an opening station B, where the filling opening 6 is opened by spreading the walls 3, 4 of the bag 2. The opened bag 2 then goes into a filling station C, where it is filled with the product, preferably a beverage. This is followed by a station D where the bag is rotated 90° about its vertical axis in preparation for removing the bag from the filling carousel 9 and sealing its upper opening 6 in the sealing station E. The sealing station E has a sealing carousel 11, which is driven to rotate about an axis 11' running parallel to the axes 8' and 9', so that rotation is in the direction of the arrow II and in synchronization with that of the filling carousel 9, and the filled and sealed bags are transferred to a further conveyor 12, which is indicated only schematically here.

The individual stations are described in detail below.

Figure 3:
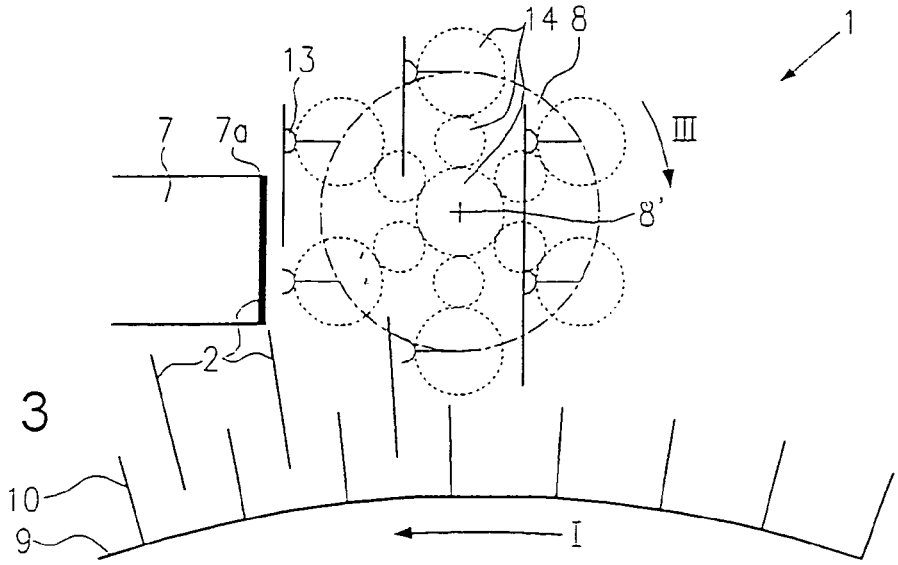
FIG. 3 a first design principle in a first mechanism of operation of the bag charging station, as seen from above.

FIG. 3 shows a schematic diagram of a first exemplary embodiment of a feeding station A. The feeding station A contains the magazine 7 in which the bags are stacked upright and individually one after the other. The magazine 7 extends essentially tangentially to the filling carousel 9 and is arranged with its feed opening 7*a* tangentially to the feeding carousel 8. The feeding carousel 8 which can be driven continuously is provided with a plurality of holding devices on its circumference, designed as suction cups 13 in the exemplary embodiment shown here. The suction cups 13 are linked to the rotation of the feeding carousel 8 by a suitable gear 14 (planetary gears having gear wheels are shown here) in such a way that the bags are transferred radially without delay to the filling carousel 9, whereby in the arrangement of the magazine 7, the feeding carousel 8 and the filling carousel 9 shown here, the orientation of the suction cups 13 remains constant at least during their movement from the feed opening 7*a* to the holders 10 of the filling carousel 9. In the exemplary embodiment shown here, the suction cups 13 are oriented essentially perpendicular to the front bag 2 in the discharge opening 7*a* and they maintain this orientation. In the exemplary embodiment depicted here, the feeding carousel 8 rotates in the clockwise direction III while the feeding carousel 9 rotates counterclockwise in the direction of rotation I shown in FIG. 1. The suction cups 13 are controlled so that they apply suction to the front bag 2 in each case as they pass by the discharge opening 7*a* of the magazine 7, conveying that bag in the same orientation into the area of the holders 10 of the filling carousel 9, where they transfer the bag to one holder 10 each.

Figure 4:
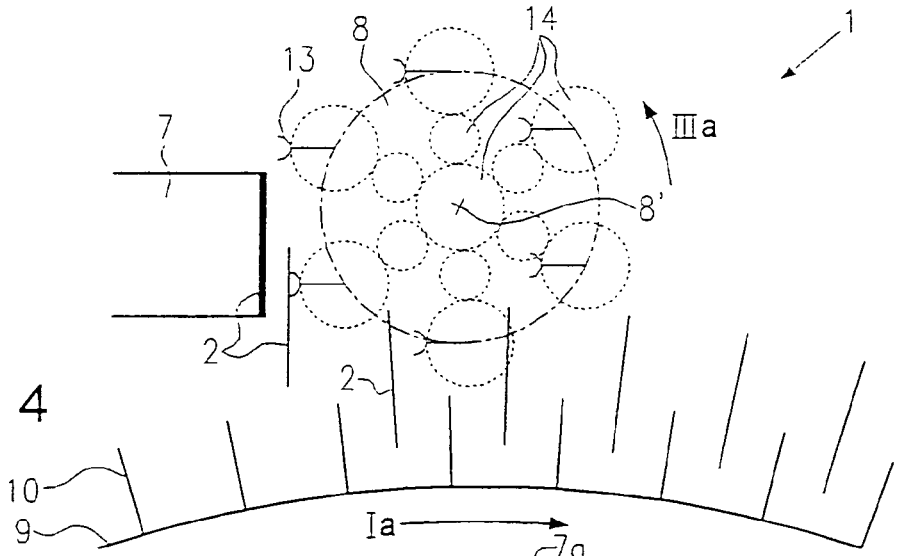
FIG. 4 the design principle of the bag charging station according to FIG. 3 in a second mode of operation.

As FIG. 4 shows, the feeding carousel 8 in FIG. 3 may also be operated in the opposite direction of rotation IIIa, i.e., counterclockwise, when the filling carousel 9 rotates in the opposite direction of rotation Ia, i.e., clockwise. The mechanism of action is identical, except that in operation according to FIG. 4, the bag must be transported over a smaller angular range of the feeding carousel 8.

Figure 5:
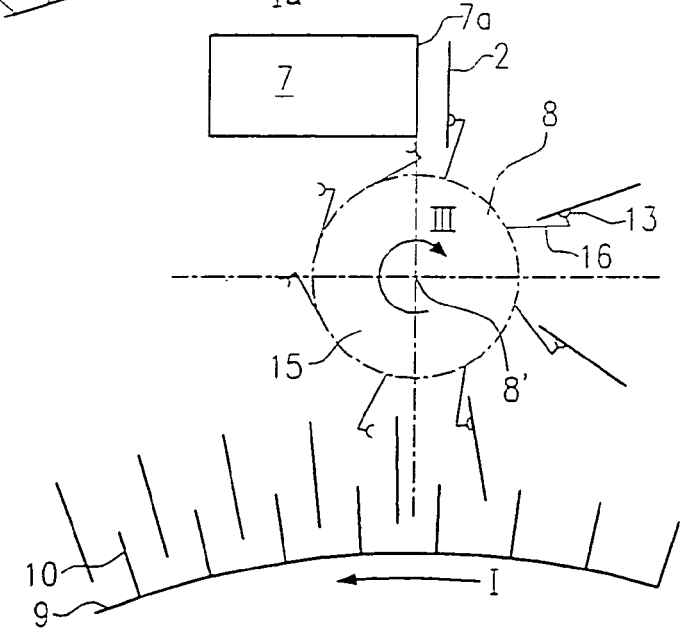
FIG. 5 another design principle of the bag charging station, as seen from above.

FIG. 5 shows a modified embodiment of a feeding carousel 8. In this embodiment, the feeding carousel 8 has a carousel body 15 on which are arranged pivotable arms 16, which also carry holding devices in the form of suction cups 13. The arms 16 are controlled so that they are pivotable from an approximately radial position with respect to the axis of rotation 8' into an essentially tangential orientation thereto. The magazine 7 is also arranged tangentially to the filling carousel 9 in this exemplary embodiment, but its discharge opening 7*a* runs essentially radially to the feeding carousel 8. The arms 16 are controlled in such a way that they are pivoted out of the discharge opening 7*a* of the magazine 7 into their radial position to accommodate the front bag 2 in each case, then they retain this position in clockwise transport of the bags 2 picked up in the direction of rotation III until the transfer of the bags 2 to the holders 10 radially to the filling carousel which is rotating in the counterclockwise direction I and in doing so rotate the bag 2 by 180°. The arms 16 are then in tangential contact with the carousel body 15 so that the distance between the magazine 7 and the feeding carousel 8 need not be too great.

In another arrangement with regard to the position and orientation of the magazine, however, another movement pattern of the suction cups may be necessary and may be implemented.

On the basis of FIGS. 6 through 11, the holding and handling of the bags in the area of the filling carousel 9 are described.

Figure 6:
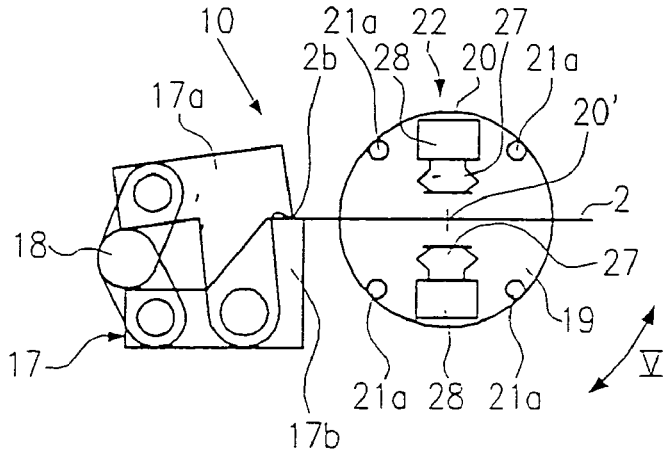
FIG. 6 a mount of the filling carousel when gripping the bag, as seen from above.
Figure 7:
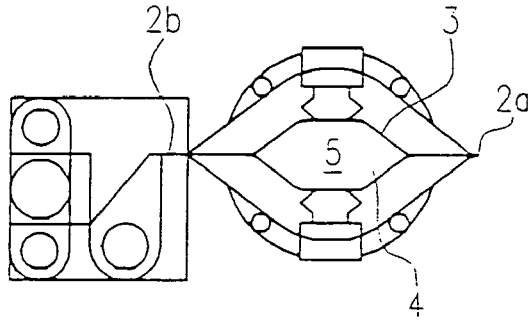
FIG. 7 a mount of the filling carousel in opening the bag, as seen from above.
Figure 8:
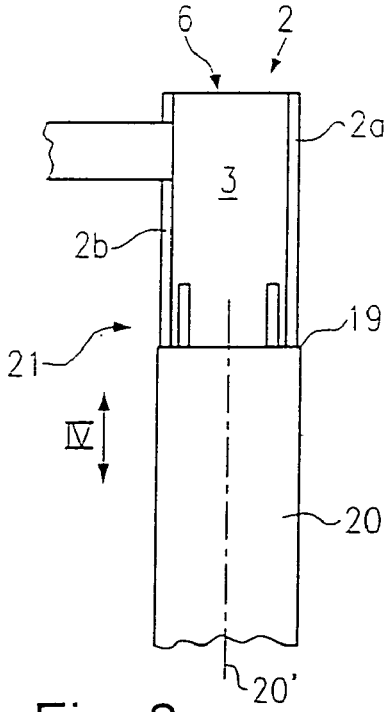
FIG. 8 a side view of the mount of the filling carousel, as seen in the direction of movement.
Figure 9:
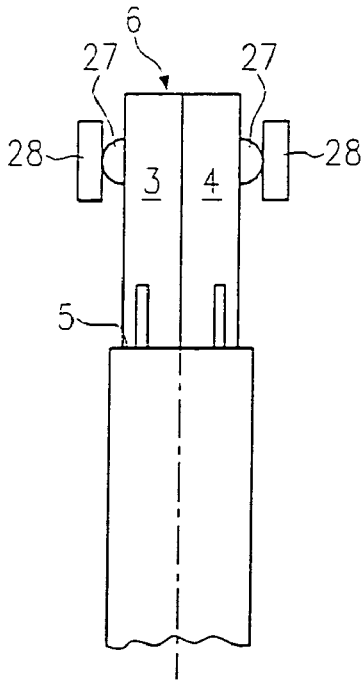
FIG. 9 a side view of a mount of the filling carousel as seen in the radial direction.

FIG. 6 shows a top view of the holder 10 at the moment of transfer of bag 2 from the feeding carousel 8. The holder 10 contains a clamping gripper 17 which consists of two clamping jaws 17*a* and 17*b* which are movable in relation to one another by means of a suitable control unit 18 (shown here as a knee joint) between an open position in which the bag 2 is released and a clamped position. In the clamped position, the clamping jaws 17*a*, 17*b* grip the inner side edge 2*b* of the bag 2, which is at the left in the figure and is on the inside radially with respect to the axis of rotation 9' of the filling carousel 9 and they hold the bag 2 in an essentially radial orientation with respect to the filling carousel 9 with the filling opening 6 pointing upward.

The holder 10 also has a support surface 19 which is provided on the top side of a ram 20. The ram 20 can be moved up and down in the direction of the double arrow IV and can be pivoted about its vertical midline 20' in the direction of the double arrow V. The midline 20' runs in its extension through the middle of the bag 2. A centering device 21 is provided on the support surface 19; in the exemplary embodiment shown here, it includes four holding fingers which stand upward and are distributed around the circumference of the bag and are spaced a distance apart, where this distance corresponds to the circumference of the bag in the area of the bottom 5 when the bag is filled, so that the bag 2 when filled is held securely in the centering device 21. The holding fingers 21*a* extend in height over approximately one-third of the height of the bag.

The holder 10 also has an opening device 22 for opening the filling opening 6 which in the exemplary embodiment shown here contains two suction cups 27 which are supplied with a vacuum and are moved by means of holding arms 28, which are only shown schematically. The suction cups 27 are arranged on both sides of the bag 2 and pull the two side walls 3, 4 apart in a known way for opening the filling opening 6.

Figure 10:
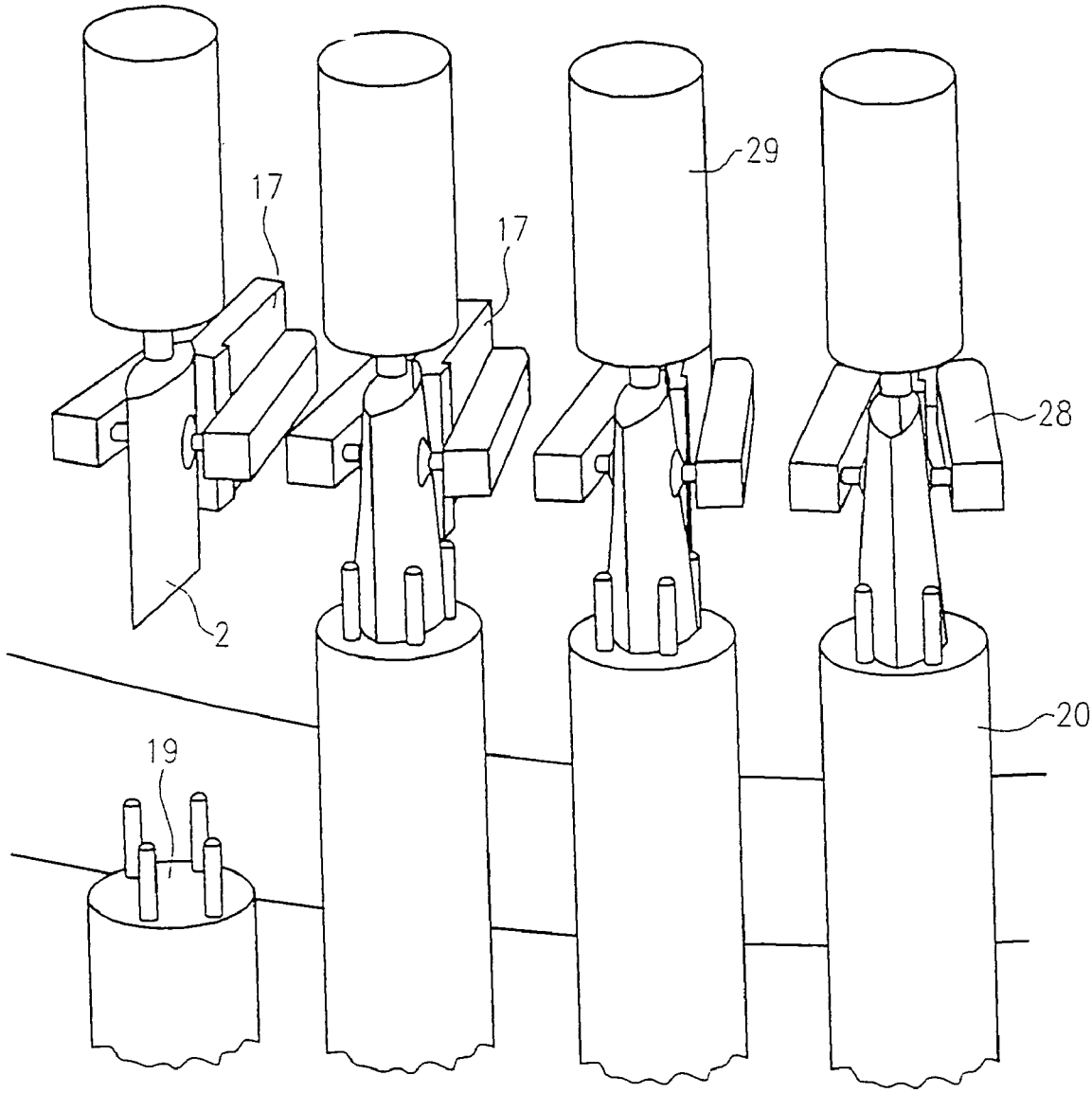
FIG. 10 a perspective diagram of a detail of a filling carousel.

As shown best in FIGS. 2 and 10, the bags 2 are transferred to the clamping grips 17 at the feeding station A while the supporting surface 19 is still in the lowered state. The supporting surface 19 then travels upward and is in contact with the standing bottom 5 of the bag. The opening device 22 is operated and opens the bag. Then the bag is filled through filling connections 29 in a known way, while the bag 2 is moved through the filling station C together with the filling connection 29 assigned to it.

Figure 11:
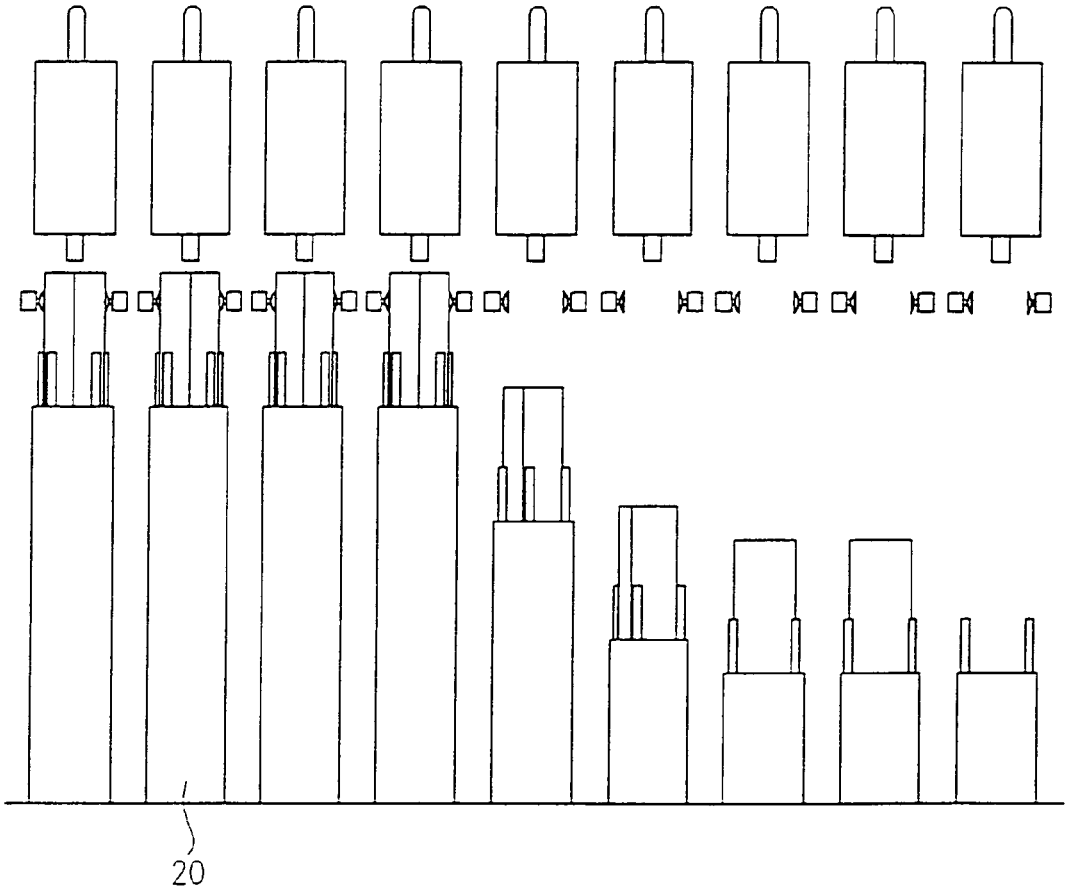
FIG. 11 a perspective diagram of another detail of the filling carousel.

Once the filling is concluded, the clamping grip of the clamping gripper 17 is released, as indicated in FIG. 11, and the holding force of the opening device 22 is also released, and the ram 20 together with the supporting surfaces 19 travels downward. Depending on the design of the sealing carousel 11, the rams 20 may rotate until the side seams 2*a*, 2*b* of the bag 2 are oriented tangentially with the filling carousel 9 and/or tangentially with the sealing carousel 11. In this position the filling opening may be sealed.

Figure 12:
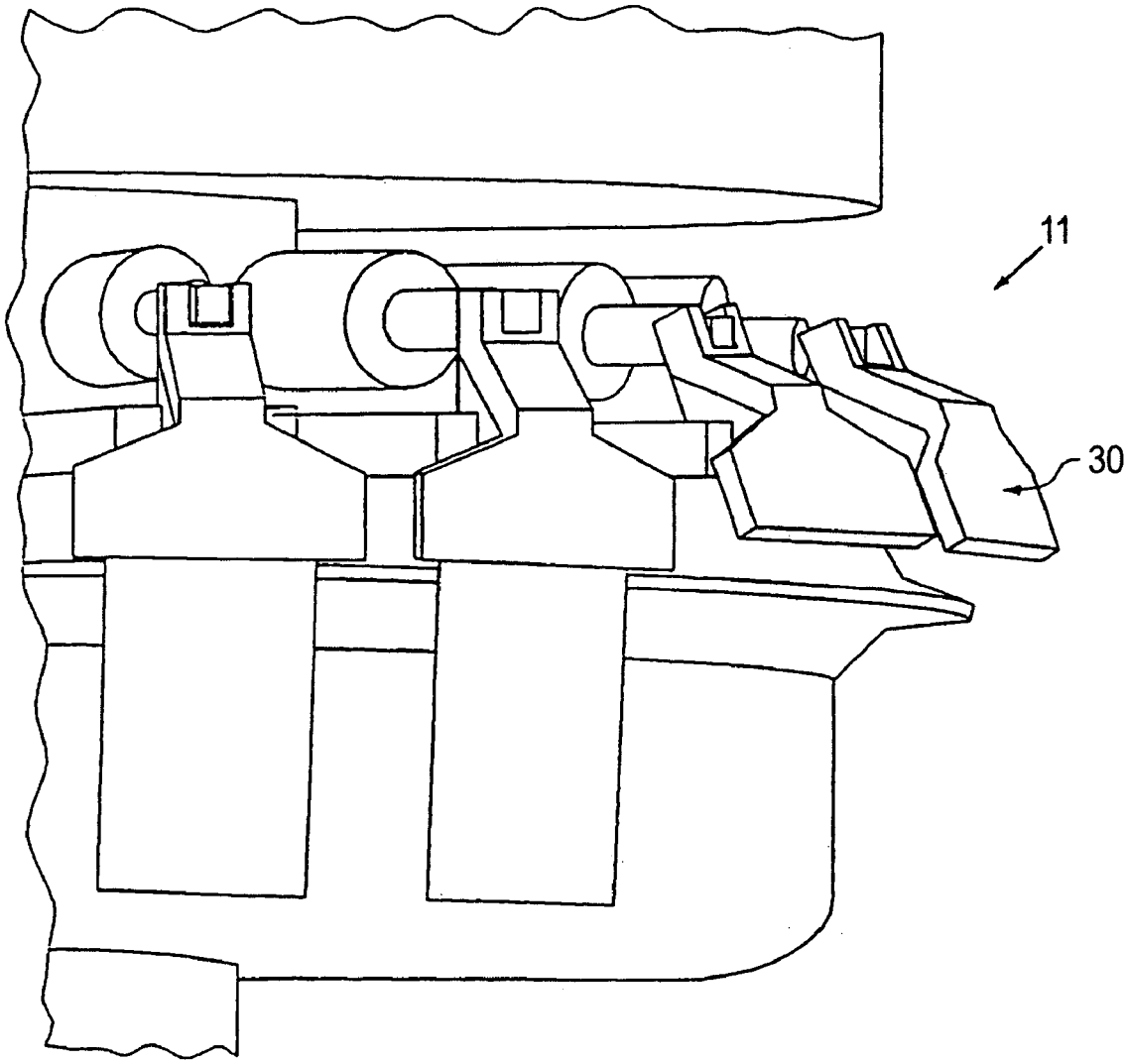
FIG. 12 a perspective diagram of a detail of the sealing carousel.
Figure 13:
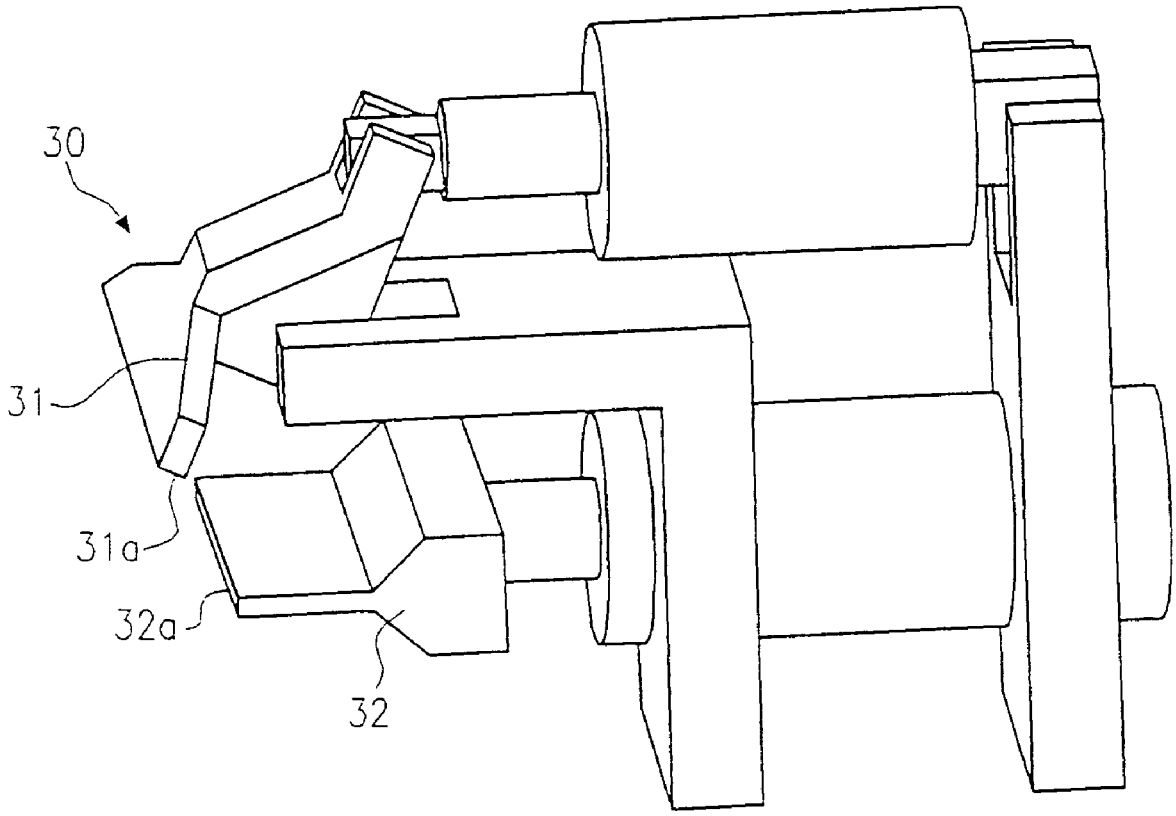
FIG. 13 a perspective diagram of the sealing jaws of the sealing carousel.

Sealing of the filling opening 6 is explained in greater detail below with reference to FIGS. 12 and 13. The sealing carousel 11 contains a plurality of sealing grippers 30 which are arranged side by side in the circumferential direction and are preferably designed as part of an ultrasonic sealing device. Each sealing gripper 30 includes a movable clamping jaw 31 with a sealing surface 31*a* and the stationary jaw 32 with a sealing surface 32*a*. The sealing surfaces 31*a* and 32*a* can be pressed together by the pivoting of the pivotable jaws 31 for clamping the upper area of the bag 2 about the filling opening 6 and can be acted upon ultrasonically so that the two side walls 3, 4 are joined together with a seal in the area of the opening 6 and the bag 2 is thus closed. The clamping surfaces 31*a*, 32*a* run tangentially to the sealing carousel and/or to the filling carousel 9, i.e., in parallel with the orientation of the bag at the sealing station E, so that the sealing grippers 30 can grip the bag well. By lowering the rams 20 with the filled bags 2 resting on them in this station, the sealing grippers 30 can be moved over the bags without colliding with the filling connections, while the bags are still being held by the supporting surface 19 in sealing so that stretching of the heated material of the bag during the sealing operation under the weight of the full bag is prevented. After sealing the ram 20 continues to move downward so that the bag hanging on the sealing gripper 30 is entrained by the movement of the sealing carousel 11, is completely cooled and is transported to the further conveyor 12 where the grippers 30 are opened so that the bags standing on their standing bottoms can be transported away through the linear conveyor 12 or through any other suitable conveyor.

In a modification of the exemplary embodiments described and drawn here, the filling carousel may also be designed with other traditional holders for the bags. The welding station need not necessarily be designed as a carousel and set up separately from the filling carousel but instead it may also be integrated into the filling carousel, for example.

Figure 14:
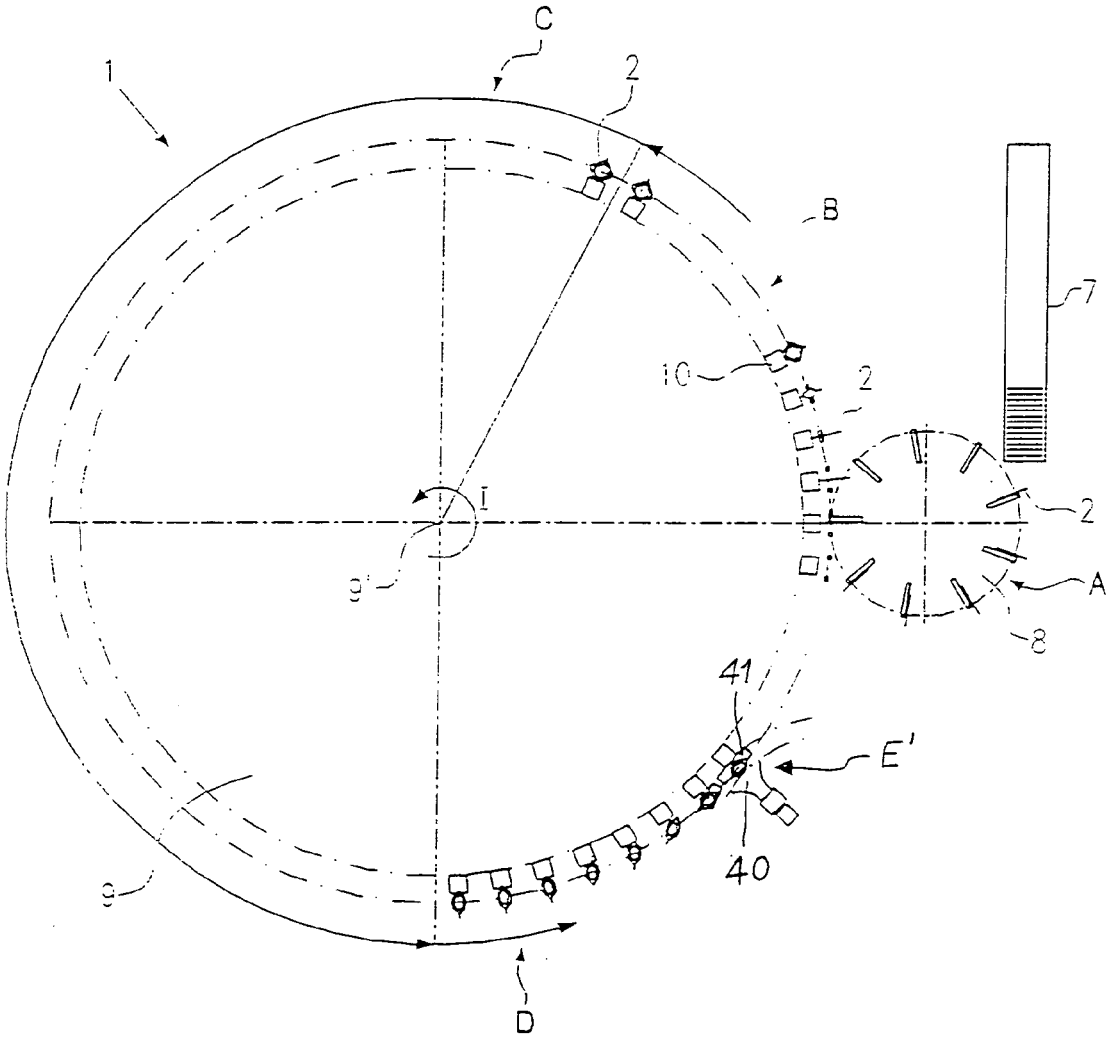
FIG. 14 a schematic diagram of a modified device according to FIG. 1, as seen from above.

According to FIG. 14, a stationary welding station E' may be arranged in the outlet area of the filling carousel 9 in such a way that its sealing molds 40, 41 are oriented tangentially with the partial circle of the filling carousel and with the peripheral cap of the upper area of the bags 2, whereby the edges which are initially still open at the filling opening 6 of a bag pass through the gap pointing tangentially in the peripheral direction between the stationary sealing molds 40,41 and meanwhile are connected with a liquid-tight seal continuously along the peripheral direction due to the influence of the ultrasonic treatment. The stationary ultrasonic vibrating unit of the welding station E' includes a sonotrode and a mating mold 41 which is designed as an anvil or a rotating roller, for example, and serves as sealing molds in their interaction. This arrangement is inexpensive on the one hand while on the other hand permitting very high material conveyance speeds which in turn permit continuous operation.

The invention claimed is:

1. Device for filling stand-alone flat-bottom bags with opposing side seams and a bottom, in particular with a liquid, comprising a continuously driven filling carousel that is capable of rotating about a vertical axis, a plurality of holders each for one bag being provided on the circumference of the filling carousel, with a bag feeding station, a bag opening station, a filling station and a removal station as well as a sealing station having a sealing carousel with a plurality of sealing devices which is arranged directly adjacent to the filling carousel, the bag feeding station having a magazine for prefabricated bags and a feeding carousel which contains a plurality of holding devices each for one bag, means for driving the feeding carousel continuously rotate about a common axis of the feeding carousel so that each bag is removed individually from the magazine and transferred in a readiabrientation continuously without delay directly to one of the holders of the filling carousel.

2. Device according to claim 1, wherein each of the plurality of holding devices of the feeding carousel includes a suction gripper.

3. Device according to claim 1 wherein the plurality of holding devices of the feeding carousel can be moved in relation to the rotation axis of the feeding carousel.

4. Device according to claim 3, wherein the plurality of holding devices are arranged to rotate about an axis on the feeding carousel.

5. Device according to claim 3 wherein the orientation of the bags in the magazine corresponds to the orientation of the bags in the filling carousel, whereby the plurality of holding devices of the feeding carousel are movably controlled so that the orientation of the bags between the magazine and the filling carousel remains unchanged.

6. Device according to claim 3, wherein the orientation of the bags in the magazine corresponds to the orientation of the bags in the filling carousel, whereby the plurality of holding devices of the feeding carousel are movably controlled so that the bags can be rotated by 180° between the magazine and the filling carousel.

7. Device according to claim 6, wherein each of the plurality of holding devices of the feeding carousel is situated on a pivot arm which is pivoted from an approximately tangential orientation to the feeding carousel into an approximately radial orientation thereto.

8. Device according to claim 1, wherein the bag opening station has suction grips which grip on opposite side walls of the bags.

9. Device according to claim 1, wherein each of the plurality of holders of the filling carousel includes a clamping grip for gripping and holding the bags on just one side seam of the bags.

10. Device according to claim 9, wherein each of the bags is oriented with its side seams radially to the axis of rotation in the filling carousel, and each of the clamping grips grips the side seam that is on the inside radially.

11. Device according to claim 1, wherein each of the plurality of holders has a clamping grip for gripping a side seam of the bags and has two suction grips which are arranged symmetrically with the clamping grip and is moved in relation to one another, each gripping a side wall of the bags for opening the bags.

12. Device according to claim 1, wherein each of the plurality of holders includes a support surface for the stand-alone bottom of the bags.

13. Device according to claim 12, wherein the support surface is moved up and down.

14. Device according to claim 12, wherein the support surface is rotated about a vertical axis.

15. Device according to claim 12, wherein the support surface includes a centering device for the bags.

16. Device according to claim 1, wherein the sealing carousel revolves around a common axis and the sealing devices are for one bag each, whereby the sealing devices are movable to remove a bag via the plurality of holders of the filling carousel.

17. Device according to claim 16, wherein each of the plurality of sealing devices has sealing jaws with a holding function for sealing bags and for removing the bags from the filling carousel and for transferring the bags to a further conveyor.

* * * * *

UNITED STATES PATENT AND TRADEMARK OFFICE

CERTIFICATE OF CORRECTION

PATENT NO. : 7,162,852 B2
APPLICATION NO. : 10/491182
DATED : January 16, 2007
INVENTOR(S) : Erich Eder It is certified that error appears in the above-identified patent and that said Letters Patent is hereby corrected as shown below:

On the Title Page:

At field (30), "102 35 929" should be -- 10235929.6 --.

In the Claims:

At Column 6, line 34, "readiabrientation" should be -- radial orientation --.

Signed and Sealed this

Thirteenth Day of November, 2007

JON W. DUDAS
*Director of the United States Patent and Trademark Office*